US005486283A

United States Patent [19]

Mnich

[11] Patent Number: 5,486,283

[45] Date of Patent: Jan. 23, 1996

[54] METHOD FOR ANODIZING ALUMINUM AND PRODUCT PRODUCED

[75] Inventor: Jason G. Mnich, Riverside, Calif.

[73] Assignee: Rohr, Inc., Chula Vista, Calif.

[21] Appl. No.: 100,891

[22] Filed: Aug. 2, 1993

[51] Int. Cl.[6] ..... C25B 1/00

[52] U.S. Cl. ..... 205/174; 205/175; 205/204; 205/213; 205/917

[58] Field of Search ..... 205/111, 175, 205/174, 201, 204, 213, 917

[56] References Cited

U.S. PATENT DOCUMENTS

| | | | |
|---|---|---|---|
| 4,127,451 | 11/1978 | Marceau et al. | 204/38 A |
| 4,566,952 | 1/1986 | Sprintschnik et al. | 205/201 |
| 4,894,127 | 1/1990 | Wong et al. | 204/58.5 |
| 5,271,804 | 12/1993 | Muller et al. | 252/79.2 |

*Primary Examiner*—John Niebling

*Assistant Examiner*—Edna Wong

*Attorney, Agent, or Firm*—Patrick J. Schlesinger; Frank D. Gilliam

[57] ABSTRACT

An improved method of anodizing aluminum which produces an oxide surface receptive to the formation of strong and durable bonds with epoxy adhesives and coatings with underlying bulk properties providing dissimilar metal separation and basic corrosion protection. The invention provides a two step electrolytic process which includes, firstly, anodizing the aluminum with a phosphoric acid solution and then, secondly, further anodizing the aluminum with a sulfuric and boric acid solution. A product is provided that has a final coating having two anodized regions. The first outer region produced by the phosphoric acid solution is about 3000 angstroms thick and is characterized by open pores which is particularly well suited for the establishment of stable, strong and durable bonds with epoxy primers and adhesives. The second base region produced by the sulfuric/boric acid solution provides a thick, tough, corrosion resistant region about 15,000 angstroms thick.

23 Claims, 3 Drawing Sheets

EFFECT OF PRESENT INVENTION ANODIZING PROCESS AND PRIOR ART SULFURIC ACID-BORIC ACID ANODIZING PROCESS ON ASTM D 3762 WEDGE CRACK BOND DURABILITY

| Alloy Growth* | Deoxidizing Process | Anodizing Process | Crack |
|---|---|---|---|
| 2024 Bare | Chromic Acid/Nitric Acid @ 77 deg. F for 15 minutes | Prior Art | 1.11 Inches |
| 2024 Bare | Chromic Acid/Sulfuric Acid (FPL Etch) @ 155 deg. F for 15 minutes | Prior Art | 1.54 Inches |
| 2024 Bare | Ferric Sulfate/Nitric Acid @ 100 deg. F for 7 minutes | Prior Art | 1.24 Inches |
| 2024 Bare | Ferric Sulfate/Nitric Acid @ 100 deg. F for 7 minutes | Present Invention (First step, 10 volts in 20% $H_3PO_4$ @ 85 deg. F. for 10 minutes) | 0.00 Inches |
| 2024 Clad | Ferric Sulfate/Nitric Acid @ 100 deg. F for 7 minutes | Prior Art | 2.32 Inches |
| 2024 Clad | Ferric Sulfate/Nitric Acid @ 100 deg. F for 7 minutes | Present Invention (First step, 7 volts in 10% $H_3PO_4$ @ 85 deg. F. for 10 minutes) | 0.05 Inches |
| 2024 Clad | Ferric Sulfate/Nitric Acid @ 100 deg. F for 7 minutes | Present Invention (First step, 7 volts in 20% $H_3PO_4$ @ 85 deg. F. for 10 minutes) | 0.00 Inches |
| 2024 Clad | Ferric Sulfate/Nitric Acid @ 100 deg. F for 7 minutes | Present Invention (First step, 15 volts in 20% $H_3PO_4$ @ 85 deg. F. for 10 minutes) | 0.00 Inches |

*Crack Extension after 24 hours of exposure to 122 deg. F, 95-100% relative humidity

FIG. 5

METHOD FOR ANODIZING ALUMINUM AND PRODUCT PRODUCED

BACKGROUND OF THE INVENTION

The present invention relates to an improvement in the field of anodizing aluminum and more particularly, but not by way of limitation, to an environmentally acceptable improved method for anodizing aluminum for durable, corrosion resistant adhesive bonding and paint adhesion.

It is well known that aluminum alloys are susceptible to corrosion. For maximum corrosion resistance it is now almost universally accepted to anodize aluminum by using a sulfuric acid solution followed by a sealing operation utilizing a chromated solution or, less often, by sealing the aluminum workpiece in a bath of boiling distilled water. Such a process is defined by the U.S. government in Mil-A-8625, Type II. This type of anodizing process produces a brittle oxide that is approximately 0.001–0.0003 inches thick and having typical coating weights of about 1000 mg/ft$^2$. At coating weights above the specified minimum Type II requirement of 600 mg/ft$^2$, the anodized workpiece experiences a significant decrease in fatigue properties. For this reason, the aircraft industry has preferred chromic acid anodizing. The U.S. government defines the chromic anodizing process in the Mil-A-8625, Type I specification. The chromic acid anodizing process yields acceptable corrosion resistance with coating weights as low as 200 mg/ft$^2$. Anodic coatings formed in a chromic acid solution also require a sealing operation for optimal corrosion protection.

Prior to the sealing step, aluminum oxides formed in sulfuric acid and chromic acid have pore diameters of about 150 and 250 angstroms respectively. The sealing operation causes the oxide to hydrate and chemically swell, thus substantially closing the exposed pore openings. About 15 percent hydration is typical for chromic acid anodic coatings. Sealing, thus, results in negligible surface porosity for Type I and Type II anodic coatings.

Unfortunately, chromium is a known carcinogen. The amount of chromium waste that industry can legally discharge into the air or water has been severely restricted. Such restrictions has brought about efforts by metal finishing operations to find acceptable nonchromated alternatives. This is particularly true for the aircraft industry, which relies on chromic acid anodizing for providing much of the primary corrosion protection for its products. For reasons mentioned previously, fatigue considerations prohibit Type II sulfuric acid anodizing as a suitable process substitution. However, process variations of time and voltage have been introduced to produce thin film sulfuric acid anodic coatings from standard Type II baths. The thickness of these oxide films are difficult to control since coating weights may vary widely between 300 and 600 mg/ft$^2$ depending upon the particular alloy and its position in the acid bath. The inability of this method to reliably yield a consistent coating has called into question the long term fatigue and corrosion resistance of the anodized product.

In a method described in U.S. Pat. No. 4,894,127, a dilute solution of sulfuric and boric acids produces a consistent anodic coating acceptable to the corrosion protection requirements of Mil-A-8625 Type I coatings, i.e., chromic acid anodizing. The coating thicknesses and weights obtained are also comparable to Type I coatings while pore diameters before sealing have been observed to be less than 100 angstroms. The percent of hydration due to sealing of about 5 percent indicates a very dense oxide. The addition of boric acid to the sulfuric acid electrolyte and/or the relatively high density of this coating may be the basis of fatigue and corrosion resistance of such anodized aluminum workpieces. Thus, sulfuric acid-boric acid anodizing is becoming increasingly favored by manufacturers of aircraft structures. This is true in spite of the prior shop practice of limiting the inevitable accumulation of dissolved aluminum in this solution to 3.7 grams per liter.

Although sulfuric acid-boric acid anodizing or thin film sulfuric acid anodizing may be environmentally acceptable alternatives to chromic acid anodizing, sealing in a chromated solution has until recently been viewed as a required practice. To eliminate chromium bearing solutions from all aspects of their anodizing processes, aircraft manufacturers have attempted to physically seal these oxides with polymers such as organic resins, or to coat the anodized aluminum with a suitable paint or a primer.

Resin sealing baths have been difficult and costly to maintain, generate undesirable quantities of waste and efforts to produce a reproducible uniform coating have been generally unsuccessful. Corrosion protection provided by pains and primers to unsealed anodic coatings rely upon good adhesion at the polymer/oxide interface. Problems of sporadic paint failures from sulfuric acid-boric acid and sulfuric acid anodic coatings have been experienced. Microscopic roughness related to oxide porosity is an apparent factor in determining the interlocking bonds desired to prevent these failures. The surface pore diameter must be of sufficient size to allow primer ingress and permeation into the oxide. Porosity of the oxide formed by chromic acid anodizing provides a level of adhesion performance not realized with nonchromated anodizing processes.

Much more stringent requirements for long term bond stability under stressed, hot, wet, and corrosive conditions distinguish the qualities required for bonded aircraft structures as opposed to those for paint adhesion. Mil-A-8625 Type I, Type II, sulfuric/boric acid, and thin film sulfuric acid anodizing are generally precluded from use as aluminum surface treatments prior to structural adhesive bonding. Occasional exceptions have been made in the case of aluminum bonded to galvanically dissimilar metals such as titanium and steel.

For aluminum to aluminum adhesive bonding, the prior practice has been to pickle the adherends in an elevated temperature FPL etch solution, i.e. a sodium dichromate and sulfuric acid solution. Aluminum surfaces treated in this manner produced very thin oxides of about 200 angstroms in thickness with open cells. This method produced erratic adhesive bond results until it was learned how to optimize the solution prior to use.

The following patents, while of interest in the general field to which the invention pertains, do not disclose the particular aspects of the present invention that are of significant interest.

U.S. Pat. No. 4,085,012 describes a phosphoric acid anodizing process for preparing aluminum for adhesive bonding. The oxide produced on the aluminum is between 4000 and 7000 angstroms thick depending upon the particular aluminum alloy and has anodic coating weights of about 35 and 80 mg/ft$^2$ for 2024 bare aluminum and 2024 clad aluminum respectively. The pores of this oxide are thin walled and have large pores about 400 angstrom in diameter, i.e. four times greater than what is produced by sulfuric/boric acid anodizing. Although this anodic coating is thin, fragile and provides little intrinsic corrosion inhibiting properties, the process produces environmentally stable aluminum surfaces for adhesive bonding. This thin oxide is not a fatigue concern and the superior adhesion to epoxy primers provide adequate corrosion protection for aluminum to aluminum bonded assemblies. Thus, phosphoric acid anodize has displaced the FPL etch for most aircraft bonding applications.

U.S. Pat. No. 3,940,321 discloses a method of anodizing an aluminum lithographic plate which comprises the steps of firstly anodizing the aluminum by electrolysis in sulfuric acid solution, and secondly, anodizing the aluminum by electrolysis in a phosphoric acid solution. The surface of the aluminum is preferably grained first, by electrolysis in dilute hydrochloric acid. It has been found that the method of this patent yields uncertain results since the phosphoric acid is very aggressive on the anodized region that has been anodized by the sulfuric acid solution.

As previously mentioned, thicker anodic coatings are used for adhesive bonding when dissimilar metals are fayed together. For these bond applications, the thin and delicate FPL etch and phosphoric acid anodize coatings do not provide the insulative separation desired to prevent galvanic coupling. Also, additional protection of the aluminum is beneficial for corrosion prone, dissimilar metal bond applications. Prior art for this unique bonding application has been to use aluminum treated per the Mil-A -8625, Type I specification. Considerations of fatigue resistance, dielectric separation, and inherent corrosion resistance are reasons for preferring chromic acid anodizing. Although unsealed Type I oxide coatings have the largest surface porosity and provides the best adhesion of any industrially practiced corrosion inhibiting anodize treatment, it is deficient in its wet peel strength with epoxy resins when compared to oxides formed in phosphoric acid. Thus, problems with less than optimum bond strength and chromium effluents remain with manufacturers of aircraft components requiring adhesive bonding of dissimilar metals.

SUMMARY OF THE INVENTION

Briefly stated, this invention relates to an improved method of anodizing aluminum which produces an oxide surface that is receptive to the formation of strong and durable bonds with epoxy adhesives and coatings with underlying bulk properties providing dissimilar metal separation and basic corrosion protection. More specifically, the invention relates to a two step electrolytic process which first provides for anodizing with a phosphoric acid solution then provides for another anodizing cycle provided by a mixture of sulfuric and boric acids.

In the preferred practice of the invention, an aluminum alloy is provided with an aluminum oxide having two complimentary yet distinct regions. By anodizing in a bath of phosphoric acid a thin, porous, highly adherent oxide is formed. If the aluminum workpiece is thereafter rinsed with water and immediately reanodized in a bath containing weak concentrations of sulfuric acid and boric acid, the previously formed oxide region becomes the surface of a new oxide with the preferred thickness of the two regions together being about 15,000 to 31,000 angstroms for various aluminum alloys. The boric acid-sulfuric acid solution is tolerant to aluminum concentrations far in excess of 3.7 g/l. Both aqueous anodizing solution baths are effective at room temperature.

An aluminum workpiece is immersed in a 10–20% phosphoric acid bath where it is the anode. The voltage is ramped to about 5–15 volts to provide a minimum part-to-solution voltage of about 2 volts. This anodizing cycle lasts at least 10 minutes. The aluminum workpiece is immediately rinsed with water and transferred to a bath of composing of about 3–5% sulfuric and about 0.5–1% boric acid where it is anodic and about 15 volts is applied for the time required to achieve an oxide coating on a bare aluminum workpiece of about 350 mg/ft$^2$ and about 600 mg/ft$^2$ on a clad aluminum workpiece. The anodized aluminum workpiece, after it has been rinsed and dried, may then be prepared for structural adhesive bonding or primed and painted for mechanical installation and assembly.

BRIEF DESCRIPTION OF THE DRAWINGS

FIG. 5 is a table comparing the effect of the present invention compared to a prior art anodizing process on wedge crack bond durability.

DETAILED DESCRIPTION OF THE PREFERRED EMBODIMENT

Figure 1:
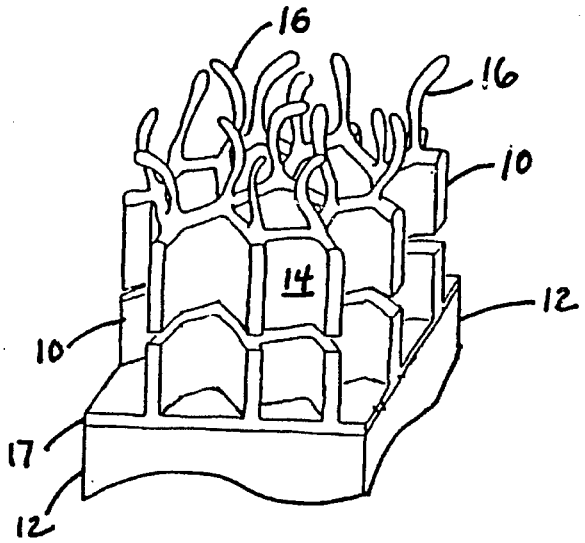
FIG. 1 is an isometric drawing of an oxide coating produced by anodizing in a phosphoric acid solution and is idealized from transmission microscopy data.

Referring now to the drawings in detail, and in particular to FIG. 1, which illustrates an idealized micrograph of an anodized region 10 of an aluminum workpiece 12 that has been anodized with a phosphoric acid. The region 10 is shown as shortened vertically to illustrate the unique features more clearly. The region 10 is about 4,000 angstroms thick and is characterized by hexagonal cells or pores 14 that are about 400 angstroms in diameter with vertically-extending whisker like members 16 that are about 1000 angstroms in height and have a thickness on the order of 100 angstroms. A further anodized barrier region 17 that is about 250 angstroms in thickness has been detected.

Figure 2:
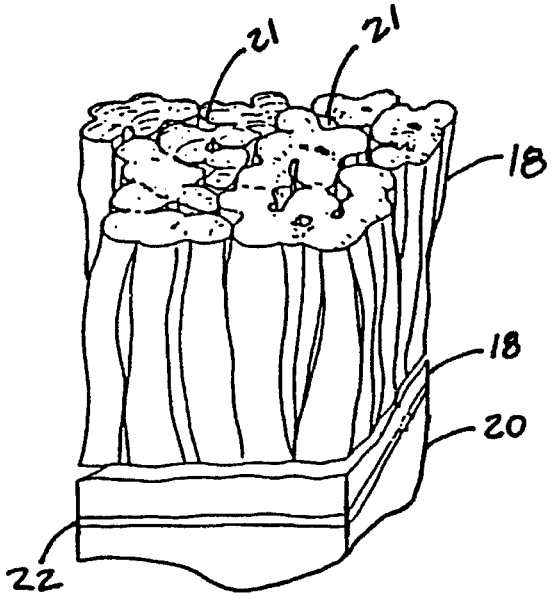
FIG. 2 is an isometric drawing which illustrates an idealized anodic coating produced by a sulfuric acid-boric acid solution.

Referring now to FIG. 2, an idealized micrograph of a region 18 of an aluminum workpiece 20 that has been anodized by a sulfuric acid-boric acid solution. The foreshortened region 18 is characterized by a thickness of about 15,000 angstroms. As can be seen from an inspection of FIG. 2, the region is dense and has relatively few pores which are spaced about 400 angstroms apart and that are small in diameter. These pores 21 extend downwardly through the region 18 to the base aluminum 20. A further barrier anodized region 22 has been detected and its thickness is 250 angstroms.

Figure 3:
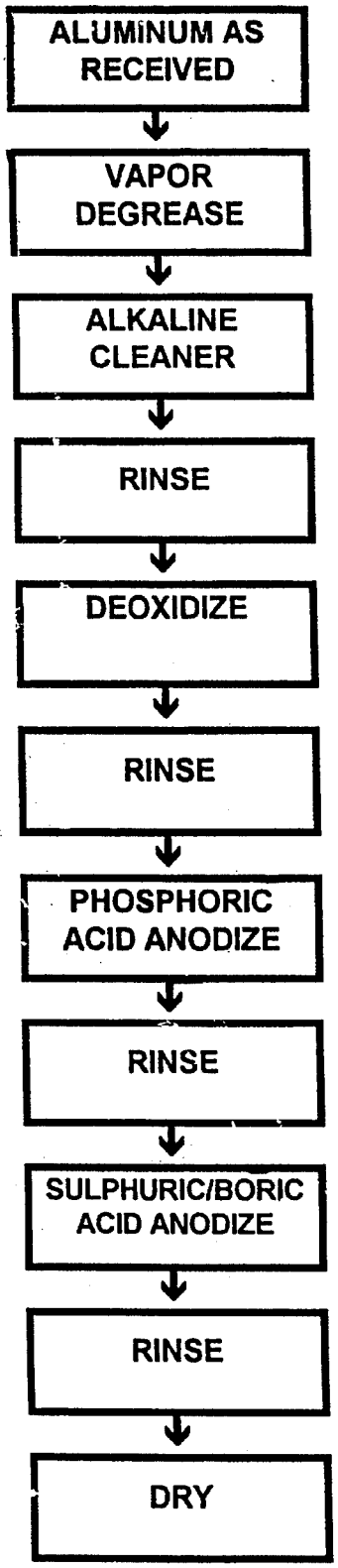
FIG. 3 is a flow diagram of a preferred embodiment of the process of the invention.

In FIG. 3, a flow diagram for the process of the invention is seen. The process of the instant invention is directed toward the improved anodizing of aluminum. The anodizing method of the invention is a two step process utilizing electrolytic baths previously reserved for distinctly different purposes. This method is effective in producing a coherent oxide coating with a thin region at the surface of the workpiece that is particularly well suited for the establishment of stable, strong and durable bonds with epoxy primers and adhesives while a thick, tough, corrosion resistant region makes up the base of the anodic coating. The porous surface region is about 3,000 angstroms thick while the underlying, denser region is about 15,000 angstroms in thickness.

The steps of the process are described hereinafter in detail. The aluminum pads, as received, are often covered with soluble organic contaminates such as cutting oils or protective greases. Such contaminates are removed by vapor degreasing using such materials as 1,1,1 trichloroethane, trichloroethylene, or perchloroethylene. In the event that the aluminum part as received does not display such contamination, then this step may be omitted.

The aluminum workpieces are then transferred into a suitable alkaline cleaning solution to remove various contaminates that collectively referred to as shop dirt. A suitable alkaline cleaner contains various sodium salts with multiple surfactants, syndets, emulsifiers, flocculents, and wetting agents. Such alkaline cleaners are well known in the art. The cleaning of the aluminum workpieces is most effectively conducted with the alkaline cleaner solution being well agitated and having an elevated temperature, such as about 140 deg. F. The typical immersion time for the aluminum workpieces in the alkaline cleaner solution is about 10 to 20 minutes, which step is then followed by rinsing the aluminum workpieces in hot water to remove all traces of the is cleaner and the removed dirt.

Prior to conducting the first anodizing step, the natural oxide of the aluminum workpieces must be stripped away in preparation for forming the desired anodic coating. The cleaned aluminum workpieces are then immersed in a suitable deoxidizing solution. Such solutions are typically non-smutting acid solutions of chromic/sulfuric acid, chromic/nitric acid or ferric sulfate/nitric/sulfuric acid aqueous solutions. The deoxidizer preferred in the practice of the present invention is a deoxidizing solution based on a ferric sulfate oxidizing agent, because of the environmental and disposal problems associated with chromated solutions. The immersion time of the aluminum workpieces in the deoxidizing bath, is based on the etch rate of the particular deoxidizer. An etch rate between 0.00015 and 0.00042 inches/surface/hour on clad aluminum results in an immersion time of about 5 to 15 minutes. The aluminum workpieces are then suitably rinsed with water to remove any residue of the deoxidizing agent.

The aluminum pads are then transferred into the first anodizing electrolyte where the surface anodic region is formed in a 75–90 deg. F. aqueous solution of 10 to 20% by weight $H_3PO_4$. The aluminum part is made anodic when about 5 to 15 volts of direct current is applied. The terminal voltage applied must be sufficient to provide a minimum part-to-solution voltage of 2 volts. This is determined by monitoring the voltage between the solution and the part. A voltmeter and a probe tip positioned about one inch away from the anodizing surface of the aluminum workpiece is used for this purpose.

Under these conditions, the oxide growth and oxide dissolution on the surface of the aluminum workpiece are about equal after about 10 minutes. Oxide growth during is this step is limited to temperature, concentration of the phosphoric acid and the applied voltage. Thus, the thickness of the oxide formed during the first step is independent of the immersion time after about 10 minutes. It has been found that an anodizing time of 25 produces the same oxide thickness as an anodizing time of 10 minutes. A reproducible porous oxide layer about 5,000 angstroms thick thus results on a clad aluminum workpiece with such layer generally having the physical characteristics as seen in FIG. 1.

Immediately after the electrical current to the phosphoric acid solution is turned off, the aluminum workpiece is rinsed with water and transferred to another aqueous anodizing solution for performance of the second step of the process of the invention. The second aqueous anodizing solution is made up with 3–5% by weight $H_2SO_4$ and 0.5 to 1% $H_3BO_3$ by weight. With this sulfuric/boric acid solution maintained at 75 to 85° F., a direct current voltage of 14 to 16 volts is applied with the aluminum workpiece parts being anodic. The aluminum workpieces remain immersed in this solution until a final oxide coating weight of about 500–650 mg/ft$^2$ and a thickness about 20,000 to 31,000 angstroms on a clad 2024 aluminum is achieved, which typically occurs at about 20 minutes. A final coating weight of about 250–350 mg/ft$^2$ and a thickness about 15,000 to 16,000 is achieved on a bare 2024 aluminum workpiece. The aluminum workpieces are then rinsed with water and dried. A suitable adhesive bonding primer or any other suitable organic coating is applied within 48 hours after completion of the process.

The present invention is based on the principle that anodic coatings grow from the bottom of the forming oxide layer. Thus, the portion of the anodic coating formed first becomes the surface of the anodic coating and is continually exposed to the electrolyte during the anodizing process. For most anodizing solutions used in industry, the surface of the growing oxide is continually being etched away as new oxide forms and grows from the oxide base/metal interface. I have found however, that the sulfuric/boric acid solution has an unusually low aluminum oxide dissolution rate. After 20 minutes immersion in the sulfuric/boric acid solution, the phosphoric acid anodize coating looses about 10 mg/ft$^2$ of its original coating weight. Hence 5,000 angstroms thick oxide coating formed in phosphoric acid becomes the 4,000 angstrom surface region of the final coating as seen most clearly in the micrograph taken by a scanning electron microscope with a magnification of 20,000 in FIG. 4. While the loss of aluminum oxide in the sulfuric/boric anodizing solution, albeit small, will accumulate with use I have found no loss in effectiveness of the sulfuric/boric acid solution with aluminum concentrations of up to 7 g/l, which is far in excess of the prior art limit of 3.7 g/l.

Figure 4:
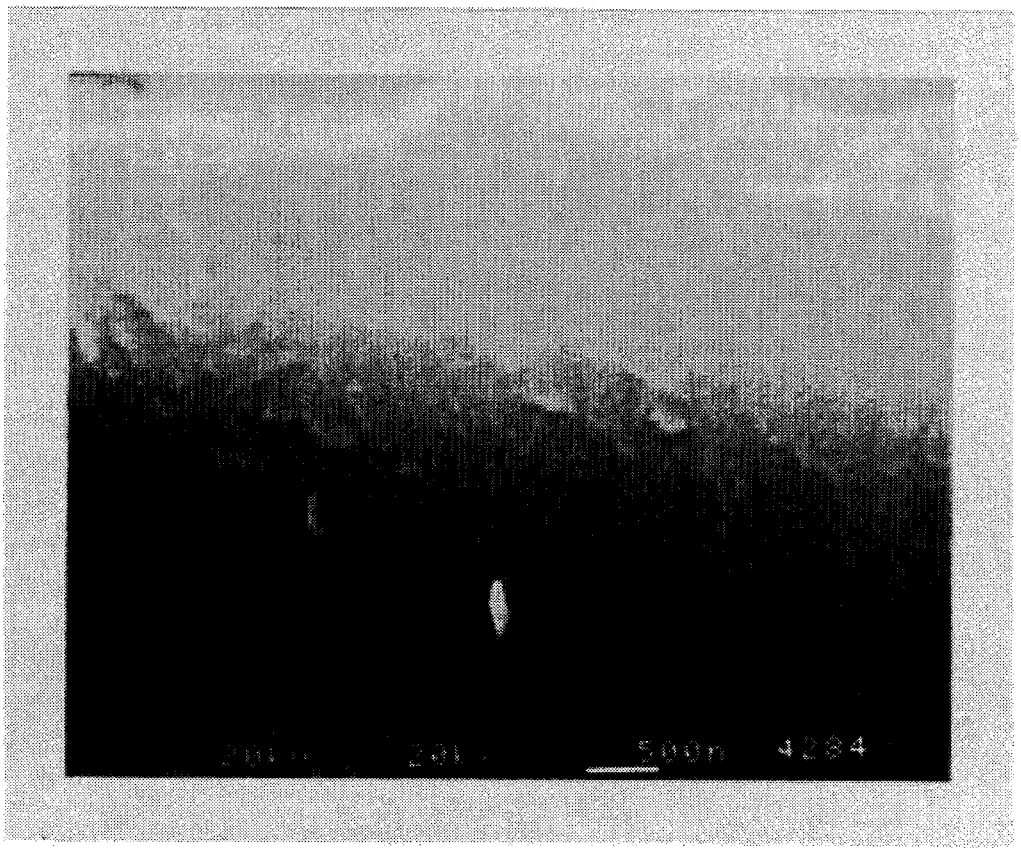
FIG. 4 is a micrograph made by a scanning electron microscope of the two region anodic coating produced by the invention.

While I have identified two distinct regions within the final coating, it is clear that each oxide column is continuous from the surface to the aluminum interface. A rapid funnelling of the oxide pores from large diameters of about 400 angstroms within the surface region to less than 100 angstroms through the base region, as seen in FIG. 4, provides a demarcation. The cell walls become thicker as the pore size decreases as the second anodizing solution percolated downwardly through the pores of the first anodic region established by the first anodizing solution. FIG. 5. is a table which compares the affect of the present invention on wedge crack bond durability, as conducted according to the ASTM D 3762 test procedure. The tests are performed using various aluminum alloys. A comparison is made of the crack growth between the anodizing process of the present invention and a sulfuric acid/boric acid anodizing is process that is commonly used at present. Excess crack growth has been correlated to in-service structural failures and the present invention shows a demonstrable improvement in the art.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A chromium free method of anodizing an unroughened aluminum alloy workpiece to produce an oxide surface receptive to the formation of strong and durable bonds with epoxy adhesives and coatings and resistant to corrosion comprising the steps of:

providing a first aqueous anodizing solution consisting essentially by weight of about 10–20% phosphoric acid;

maintaining said first anodizing solution at a temperature from about 75° to 90° F.;

immersing said workpiece in said first anodizing solution;

applying a direct electric current having a voltage of about 5 to 15 volts across the workpiece in said solution, such that the current density is substantially uniform across the workpiece and does not exceed about 10 amperes per square foot, for a period of time sufficient to produce a thin, porous, highly adherent oxide at least 5000 angstroms thick on the surface of said workpiece;

providing a second aqueous anodizing solution consisting essentially by weight of 3–5% sulfuric acid and 0.5–1.5% boric acid;

maintaining said second anodizing solution at a temperature from about 75° to 85° F.;

removing the workpiece from the first anodizing solution and immersing it in the second anodizing solution;

applying a direct electric current having a voltage of about 15 volts across the workpiece in said solution, such that the current density is substantially uniform across the workpiece and does not exceed about 10 amperes per square foot, for a period of time sufficient to produce a further growth of a less porous oxide on the workpiece with the final oxide coating having a weight of around about 250 to 650 milligrams per square foot and a thickness of about 15,000 to 31,000 angstroms, which final oxide coating does not substantially reduce the fatigue resistance of the workpiece.

2. The method defined in claim 1 wherein the workpiece is immersed in the second anodizing solution while having an electric current applied to it for a time sufficient to produce a final oxide coating having a weight about 250–350 milligrams per square foot and a thickness about 15,000 to 16,000 angstroms when the workpiece is a bare aluminum alloy.

3. The method defined in claim 1 wherein the workpiece is immersed in the second anodizing solution while having an electric current applied to it for a time sufficient to produce a final oxide coating having a weight about 550–650 milligrams per square foot and a thickness about 20,000 to 31,000 angstroms when the workpiece is a clad aluminum alloy.

4. The method as defined in claim 1 wherein the application of direct electric current to the workpiece in the first solution maintains at least a workpiece-to-solution voltage of 2 volts.

5. The method as defined in claim 1 wherein the application of direct electric current to the workpiece in the first solution is maintained for about 8 to 22 minutes.

6. The method as defined in claim 1 wherein the application of direct electric current to the workpiece in the first solution is maintained for at least 10 minutes.

7. The method as defined in claim 1 wherein the workpiece is maintained as the anode during application of the direct electric current during its immersion in both the first and second anodizing solutions.

8. The method as defined in claim 5 wherein the application of direct electric current to the workpiece in the second solution is maintained for about 20–25 minutes.

9. The method as defined in claim 1 which further includes, prior to immersing the workpiece in a first anodizing solution, providing an aqueous deoxidizing solution and immersing said workpiece in the deoxidizing solution for a period sufficient to strip away the natural oxide appearing on the surface of the workpiece.

10. The method as defined in claim 9 wherein the aqueous deoxidizing solution includes sufficient ferric sulfate acid to provide an etch rate around 0.00015 to 0.00042 inches/surface/hour on an aluminum alloy workpiece.

11. The method as defined in claim 10 wherein the workpiece is immersed in the deoxidizing solution about 5 to 15 minutes.

12. The method as defined in claim 11 and which further includes, prior to immersing the workpiece in the deoxidizing solution, providing an agitated aqueous alkaline cleaning solution maintained at about 140° F. and immersing the workpiece in the cleaning solution for about 10–20 minutes to remove any surface contamination, such as cutting oils or protective greases.

13. The method as defined in claim 11 which further includes the steps of thoroughly rinsing the workpiece immediately following each immersion step with demineralized water to remove any residue of the solution in which the workpiece had been immersed.

14. The method as defined in claim 13 which further includes, after the workpiece has been thoroughly rinsed with water following immersion in the second anodizing solution, the step of immediately drying the workpiece and, within 48 hours following the drying step, coating the workpiece with an organic coating.

15. The method as defined in claim 1 wherein the organic coating is an adhesive bonding primer.

16. A chromium free method of anodizing an unroughened aluminum alloy workpiece to produce an oxide surface receptive to the formation of strong and durable bonds with epoxy adhesives and coatings and resistant to corrosion comprising the steps of:

immersing a workpiece ina first anodizing solution for a time sufficient to form a first thin porous highly adherent oxide layer on the surface of the workpiece, said first oxide layer being about 5,000 angstroms thick and having pores having diameters of about 400 angstroms;

immersing the workpiece in a second anodizing solution so as to permit the second solution to percolate through the first porous oxide to the interface between the base of the first oxide layer and the base metal of the workpiece and cause a second less porous oxide layer to commence to grow from said interface, which second anodizing solution has a low aluminum oxide dissolution rate;

maintaining the workpiece in the second anodizing solution until the weight of the combined first and second oxide layers achieves a weight of approximately 250–650 milligrams per square foot.

17. The method as defined in claim 16 wherein the workpiece is a bare aluminum alloy workpiece and the workpiece is immersed in the second anodizing solution for a time sufficient to produce a final oxide coating having a weight of about 250–350 milligrams per square foot and a thickness of about 15,000 to 16,000 angstroms.

18. The method as defined in claim 16 wherein the workpiece is a clad aluminum alloy workpiece and the workpiece is immersed in the second anodizing solution for a time sufficient to produce a final oxide coating having a weight of about 550–650 milligrams per square foot and a thickness of about 20,000 to 31,000 angstroms.

19. The method as defined in claim 16 wherein the about 5,000 angstrom thick first oxide layer is reduced to about 4,000 angstroms while the workpiece is immersed in the second anodizing solution.

20. The method defined in claim 16 wherein the second immersion step also causes the said second solution as it percolates through the first oxide layer to cause the shape of the pores in the combined layers to assume funnel shapes having a diameter of about 400 angstroms in the first layer and a diameter of about 100 angstroms in the second layer.

21. The method defined in claim 16 which further includes, prior to the immersion of the workpiece in the first anodizing solution, the step of immersing the workpiece in a deoxidizing solution for a period sufficient to strip away the natural oxide appearing on the surface of the workpiece.

22. The method as defined in claim 20 which further includes, after each immersion step, rinsing the workpiece in demineralized water to remove any residue of the particular immersion solution and drying the workpiece following the last rinsing step.

23. The method as defined in claim 21 wherein the workpiece is immersed in the first anodizing solution while having an electric current applied to it for at least 10 minutes.

* * * * *